US005318195A

United States Patent [19]

Kahanek et al.

[11] Patent Number: 5,318,195

[45] Date of Patent: * Jun. 7, 1994

[54] SINGLE VEND DEVICE FOR A NEWSPAPER VENDING MACHINE

[75] Inventors: Alan P. Kahanek, Yoakum; Ralph J. Ullmann, Shiner, both of Tex.

[73] Assignee: Kaspar Wire Works, Inc., Shiner, Tex.

[ * ] Notice: The portion of the term of this patent subsequent to Sep. 1, 2009 has been disclaimed.

[21] Appl. No.: 927,157

[22] Filed: Aug. 7, 1992

Related U.S. Application Data

[63] Continuation-in-part of Ser. No. 775,616, Oct. 15, 1991, Pat. No. 5,143,251.

[51] Int. Cl.[5] ..... B65H 3/00

[52] U.S. Cl. ..... 221/152; 221/155; 221/207; 221/226; 221/241; 221/279

[58] Field of Search ..... 221/152, 151, 154, 155, 221/191, 192, 199, 241, 279

[56] References Cited

U.S. PATENT DOCUMENTS

| | | | |
|---|---|---|---|
| 3,747,733 | 7/1973 | Knickerbocker | 1945/10 |
| 3,912,124 | 10/1975 | Pinkerton | 221/298 |
| 4,067,477 | 1/1978 | Chalabian | 221/1 |
| 4,093,058 | 6/1978 | Terry | 194/71 |
| 4,140,242 | 2/1979 | Muller et al. | 221/154 |
| 4,174,047 | 11/1979 | Owens | 221/154 |
| 4,258,861 | 3/1981 | Traill et al. | 221/213 |
| 4,375,844 | 3/1983 | Facto | 194/54 |
| 4,377,228 | 3/1983 | Ostermann | 194/54 |
| 4,465,207 | 8/1984 | Chalabian | 221/241 |
| 4,530,444 | 7/1985 | Christian | 221/37 |
| 4,654,513 | 3/1987 | Hennessy | 235/381 |
| 4,865,178 | 9/1989 | Lewandowski | 194/227 |
| 4,981,236 | 1/1991 | Riedle et al. | 221/241 |
| 5,143,251 | 9/1992 | Kahanek et al. | 225/152 |

*Primary Examiner*—David H. Bollinger
*Attorney, Agent, or Firm*—Gunn, Lee & Miller

[57] ABSTRACT

The application discloses a device (10) to retrofit into the cabinet (11) of newspaper vending machine racks to prevent the removal of more than one copy of the newspaper for each vend or door opening of the cabinet (11). The single vend device (10) consists of a front panel (12) with a T-slot (14). The arms (14*a*) of the T-slot (14) are normally closed off with a pivoted closure plate (16). Consumer access to the newspapers is provided through the leg of the T-slot (14*b*), but the newspaper must be slid through the gap between the closure plate (16) and the front panel (12). The thickness of the gap is adjustable to selectively allow for the variation in thickness between various editions of the newspaper. The closure plate (16) is spring loaded to be biased to the closed position. Following removal of the paper, the closure of the plate (16) and a locking pin (32) prevents the plate (16) from re-opening. The locking pin (32) is disarmed upon closure of the cabinet (11) door (25*a*).

10 Claims, 8 Drawing Sheets

SINGLE VEND DEVICE FOR A NEWSPAPER VENDING MACHINE

This is a Continuation-in-Part of copending application Ser. No. 07/775,616 filed on Oct. 15, 1991, now U.S. Pat. No. 5,143,251, and which incorporates all of said patent application for all purposes.

FIELD OF THE INVENTION

This invention relates to an anti-theft device for newspaper vending machines, more particularly to an anti-theft device comprised of a front panel with a T-shaped slot, access through which is controlled by a closure plate. The degree to which the plate open is adjustably varied, selectively allowing thicker or thinner editions of a newspaper to pass therethrough.

BACKGROUND

Newspaper vending machines are an increasingly popular way of distributing newspapers throughout the country. Frequently, newspaper vending machines act on a honor system. That is, a consumer will insert the required amount of coinage into the coin mechanism of the newspaper vending machine which will then allow the consumer access to the newspaper containing cabinet of the vending machine through a manually-operated door. The door, being unlocked upon the insertion of the required amount of coinage, usually allows the consumer access to all of the newspapers. The dishonest consumer will take more than one edition of the newspaper. This is especially true when publishers, especially those in highly competitive metropolitan markets, offer a "game card," coupons, promotional inserts and the like with each edition. The dishonest consumer may take all of the editions, or at least more than the one purchased edition, in order to gain access to the game cards or coupons and increase his chances of winning a prize.

Thus, what is needed in the industry is a simple device to deter the theft of more than one newspaper with the device being capable of being retrofitted into the cabinets of existing newspaper vending machines.

The prior art discloses a number of devices designed to prevent the withdrawal of more than a single addition of a newspaper from the cabinet of a newspaper vending machine.

One such device is disclosed in U.S. Pat. No. 4,496,074 (Owens 1985). Owens discloses a vending machine for newspapers designed to prevent the theft of periodicals by dishonest customers. The device of Owens can be installed in existing vending cabinets. Owens device is capable of dispensing newspapers of widely varying thickness to the use of an elliptical newspaper release roller (39). This roller depresses and buckles the top most paper of the stack to effect its release. However, retrofitting the Owens device into an existing cabinet (such as assignee's popular "K-80") would require extensive machining of the cabinet and replacing the existing elevator mechanism of the "K-80."

U.S. Pat. No. 4,651,896 (Harold 1987) discloses another machine for vending newspapers of varying thicknesses. The Harold device provides for a normally closed barrier member self-adjusting to the thickness of various newspapers and controlled by ratchet mechanisms such that upon withdrawal of the newspaper, the blocking mechanism is reset to lock in its closed position. The Harold device, however, is not retrofittable into an existing newspaper cabinet such as the K-80, and is mechanically rather complicated.

U.S. Pat. No. 3,905,503 (Emmel 1975) discloses a newspaper vending machine to prevent the theft of newspapers utilizing a gate mounted so as to oscillate between a closed and open position, the open position allowing the removal of the top paper of the newspaper stack. The Emmel device is not easily retrofittable into existing newspaper cabinets such as the K-80.

U.S. Pat. No. 3,747,733 (Knickerbocker 1973) provides for a newspaper periodical dispensing machine. The Knickerbocker device allows for the displayed paper in the window of the cabinet to be secure until the last newspaper is withdrawn from the storage compartment. When the last newspaper is withdrawn from the storage cabinet, the Knickerbocker device unlatches the display case access door to allow the consumer to remove the display copy of the newspaper from the display case. The Knickerbocker device provides for dispensing of the top newspaper in the storage compartment when the access door is swung open. When the top newspaper is removed from the cabinet, all remaining newspapers are locked in a storage compartment. The Knickerbocker device, however, is not easily retrofittable into existing newspaper cabinets, such as the K-80, without extensive modifications thereto.

U.S. Pat. No. 4,981,236 (Riedle 1991) discloses an anti-theft device for use in a coin operated dispensing machine which is designed to be retrofittable into the K-80 cabinet manufactured by assignee of the present invention. The Riedle apparatus includes a cover panel assembly (17), cover panel mounting bracket (18), and a reset mounting tab (19).

However, the use of the Riedle device is needlessly complex, especially in the manner of retrofitting which requires the use of tools and extensive machining to modify the present cabinet of the K-80 by mounting, such as with bolts or the like, a reset mounting bracket to the inside door of the K-80, as well as mounting a cover panel mounting bracket (18) (see Riedle, FIG. 5) before the K-80 can accommodate the cover panel assembly.

Applicant's device solves a need for a less complex device by providing for a device to retrofit into the cabinets of newspaper vending machine racks to prevent the removal of more than one copy of the newspaper for each vend or door opening of the cabinet. The single vend device consists of a front panel with a T- or Y-shaped slot. The generally horizontal arms of the slot are normally closed off with a pivoted closure plate. Consumer access to the newspapers is provided through the vertical leg of the slot, but the newspaper must be slid horizontally through the discharge gap between the closure plate and the front panel. The thickness of the gap is adjustable to selectively allow for the variation in thickness between various editions of the newspaper. The closure plate is spring loaded to be biased to the closed position. Following removal of the paper and the closure of the plate, a locking pin prevents the plate from pivoting to a release position until the cabinet door is closed. The locking pin is disarmed upon closure of the cabinet door.

It is a purpose of this invention to provide for a single vend device for easily (without tools) retrofitting newspaper vending machines that will help deter the theft of more than one issue of the newspaper by providing an adjustable width closure plate and an access slot, with resettable means for locking the normally biased closure plate in a locked position following the removal of single edition through the access slot.

SUMMARY OF THE INVENTION

This invention provides an anti-theft device for newspaper vending machines having a cabinet for substantially enclosing newspapers, an elevator shelf onto which the newspapers are stacked, which elevator shelf raises as newspapers are removed from the top of the stack, a manually-operated, hingedly-attached door to provide access to the interior of the cabinet, a means for lockingly engaging the door, and a coin-control mechanism to engage and disengage a locking means. More specifically, the anti-theft device of the present invention comprises a front panel with a front and a rear surface, for substantially blocking access to the newspaper stack, the front panel having a perimeter thereon dimensioned to removably engage the cabinet of the newspaper vending machine, the front panel with walls defining a "T-shaped" opening, the generally horizontal arms of the opening being of sufficient width to extract a newspaper widthwise therefrom, the generally vertical leg of the opening being substantially less than the width of a newspaper; key operative locking means engageable with the perimeter of said front panel to lock said front plate to the walls of the cabinet; a mounting panel with a top and a bottom surface integral with said front panel located above the T-shaped opening of said front plate, said mounting base projecting substantially perpendicular from the rear surface of said front panel; a closure plate pivotally mounted to the rear surface of said front plate above the T-shaped opening and below said mounting base, the closure plate dimensioned to substantially cover the arms of the T-shaped opening, the closure plate having a flat portion and a bent portion, said closure plate with a leading edge defining the edge between the two portions, said closure plate for moving between a closed position, the closed position with the leading edge flush against the lower edge of the rear surface of the walls defining the arms of the T-shaped opening, the closed position substantially preventing access to the newspapers and an open position, said open position reached by rotation of said closure plate from the closed position until the leading edge of said closure plate is at a position removed from the walls defining the lower edge of the T-shaped opening, the open position defining an access width through which the newspaper is removed from the interior of the cabinet; a sheet slidably mounted to and flush with the bottom surface of said mounting base, the sheet operatively engaged with the rear surface of the closure plate such that movement of the closure plate towards an open position causes the sheet to slide away from said panel and across the bottom surface of said mounting base; means to adjust the access width, said means comprising walls defining a line of adjustment holes through said mounting plate, a pin dimensioned to engage the adjustment holes, and pin retainment means slidably mounted in alignment with the adjustment holes, the width adjustment means further comprising an edge of said slidably mounted plate, the edge in acute angular relationship to the line of adjustment holes; means biasing said closure plate towards the closed position; means to resettably lock the closure plate in the closed position, said closure plate lock means comprising an arm means, a pin means, and a reset means, the arm means coupled to the door of the newspaper cabinet, the arm means to raise the pin out of a hole in said sliding sheet, the hole aligned with said pin for receipt of the pin therethrough, when said closure plate is the first position, the pin released from its raised position by resent means upon movement of the closure plate from its first position, thereby allowing pin to re-engage the hole upon return of said plate to the first position.

BRIEF DESCRIPTION OF THE FIGURES

FIG. 1*d* is a perspective view of the open door of the cabinet of the newspaper vending machine.

DETAILED DESCRIPTION OF THE PREFERRED EMBODIMENT

Figure 1:
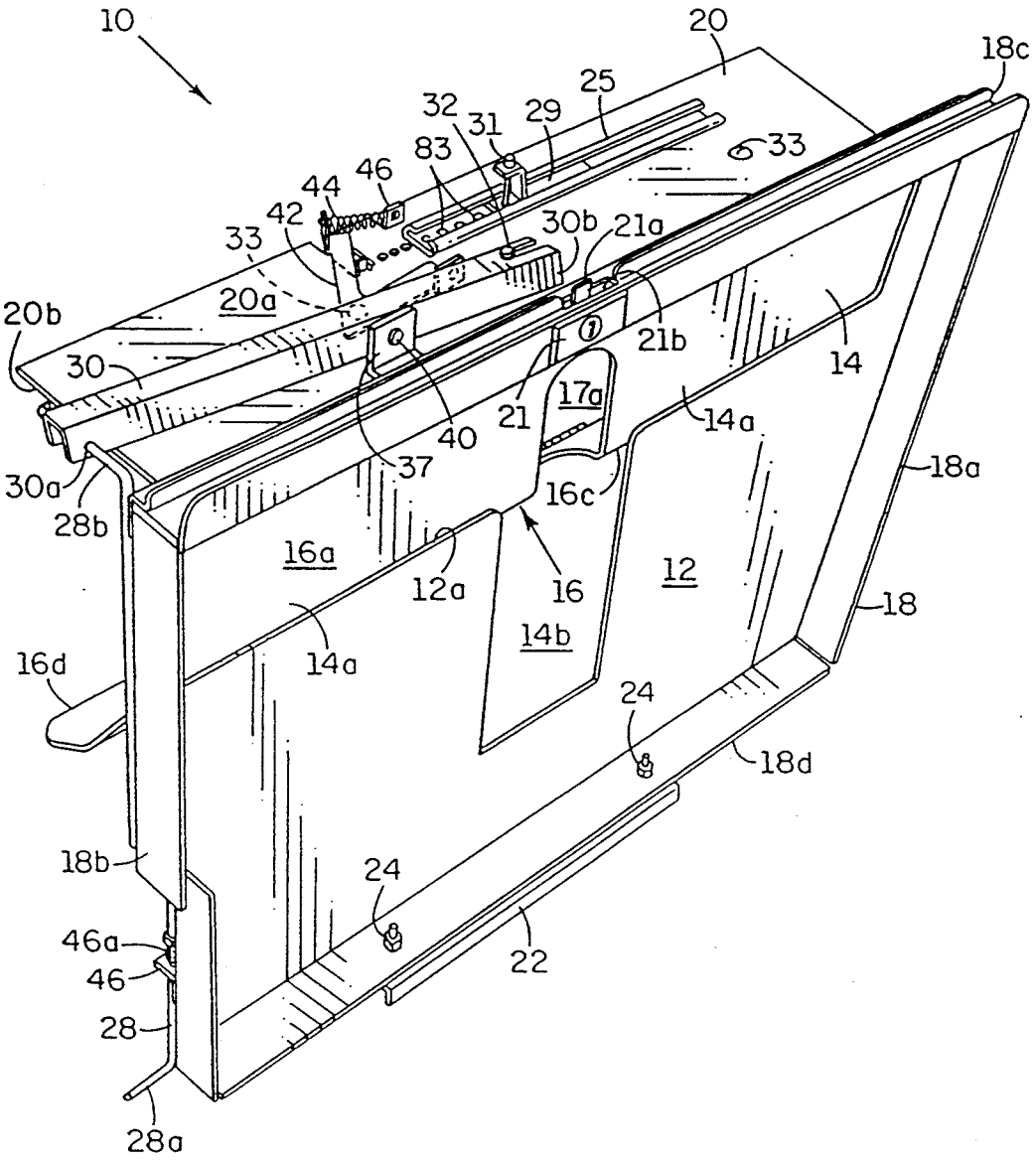
FIG. 1 is a prospective view showing the front of the theft deterrent device.
Figure 2:
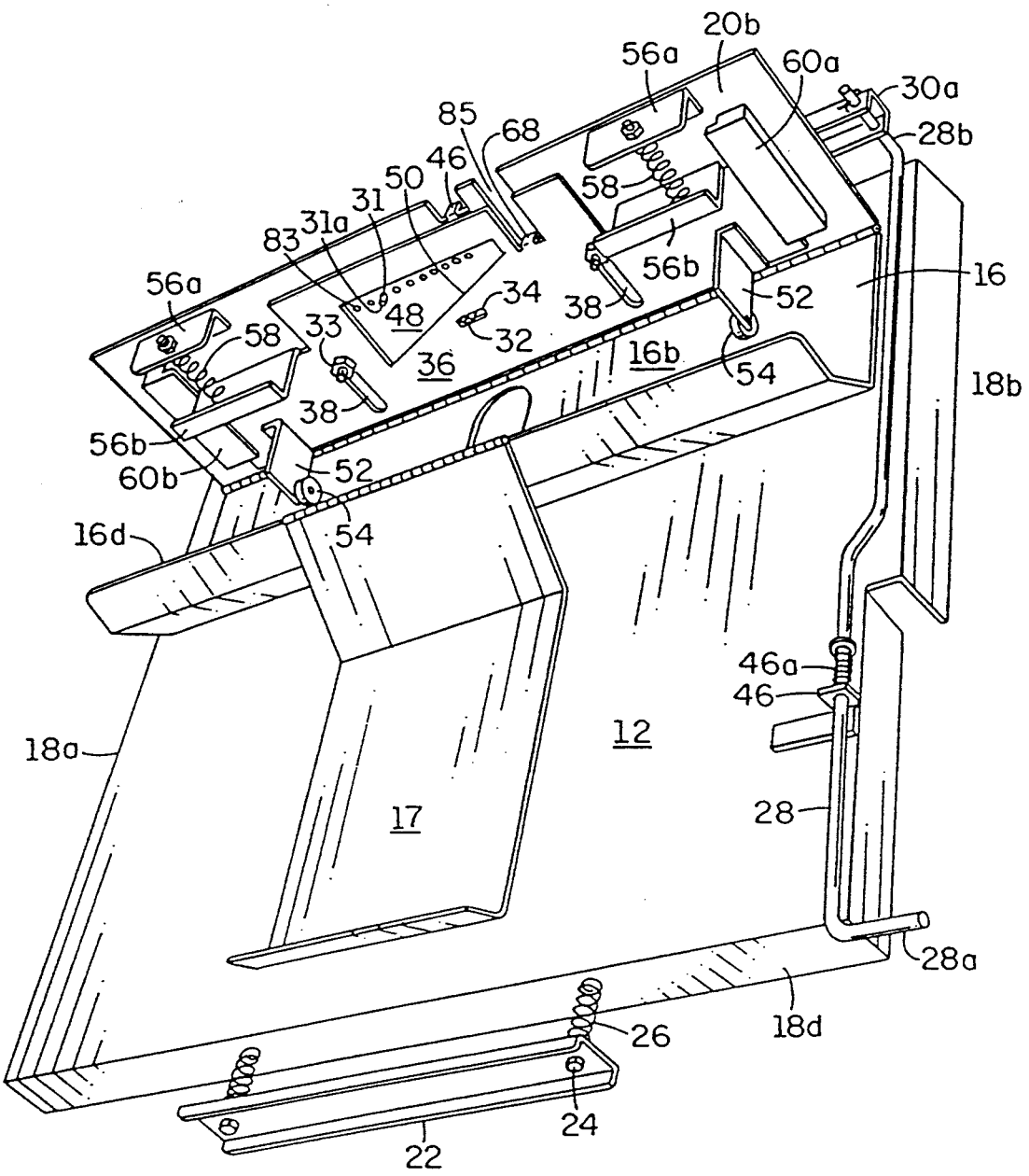
FIG. 2 is a prospective view showing the rear of the theft deterrent device
Figure 3:
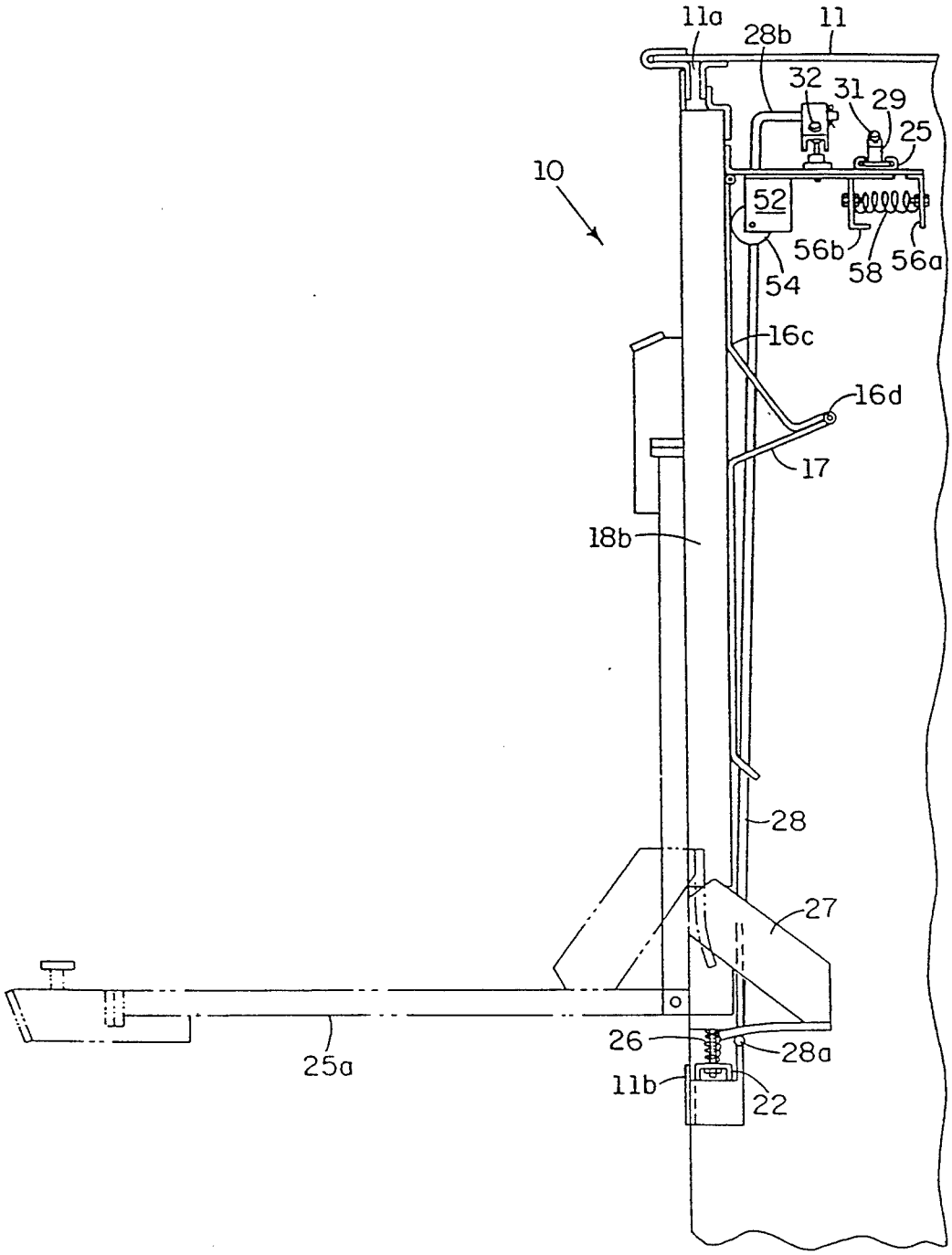
FIG. 3 is a side elevational view of the theft deterrent device.

With reference to FIGS. 1, 2, and 3 it can seen that the theft deterrent device (single vend device) (10) of the present invention is adapted to fit into a cabinet (11) and comprises a front panel (12) with a T- or Y-shaped opening (14) therein (hereinafter, reference to T-shaped will be understood to mean Y-shaped also). As it is further evidenced from FIG. 1, the T-shaped slot is dimensioned with arms (14*a*) extending generally transverse to leg (14*b*). Front panel (12) has a top edge (12*a*) defining the lower border of arms (14*a*). Access through arms (14*a*) of T-shaped opening (also called "access slot") (14) is controlled by means of a pivotally mounted closure plate (16) having a front surface (16*a*) and a rear surface (16*b*). Closure plate (16) is generally "J" shaped and has leading edge (16*c*) and trailing edge (16*d*). Cut-out (17*a*) in closure plate (16), in conjunction with leg (14*b*) in front panel (12), provides a means for the consumer to reach the newspapers. The newspaper stack (not shown) generally rests on an elevated, upwardly biased shelf which will urge the stack upward toward trailing edge (16*d*) as papers are removed. As can be seen in FIG. 1, leading edge (16*c*) lies across and just below top edge (12*a*) of the front panel when closure plate (16) is in its normally biased, closed position as represented in FIG. 1. Tail (17) is pivotally mounted centrally along trailing edge (16*d*) to hang freely therefrom. This helps keep the papers in the stack from curling up.

Turning back to front panel (12), it may be seen that perimeter (18) is integral therewith. More particularly, perimeter (18) is comprised of right side (18*a*) and left side (18*b*), top edge (18*c*) and lower (18*d*).

Further, from viewing FIGS. 1, 2, and 3, it can be appreciated that perimeter (18) is dimensioned to be received within the front opening of cabinet (11) of the newspaper vending machine. More particularly, FIG. 3 illustrates the manner in which lips (11*a*) and (11*b*) of cabinet (11) engage the groove defining top edge (18*c*) and channel (22) to retain single vend device (10) to cabinet (11).

Pausing for a moment, to discuss the function of the above cited structure, it can be appreciated that front panel (12) substantially prevents access to newspapers within the cabinet of the newspaper rack when the panel is affixed thereto. More particularly, it can be appreciated that access to the newspapers is limited to the hand of the consumer reaching through leg (14*b*) to slide the paper on top of the stack "up and out" the access slot (14) as the closure plate (16) pivots away, producing a gap between top edge (12*a*) and leading edge (16*c*). With closure plate (16) biased in a normally closed position, the removal of the newspaper through arms (14*a*) of the slot will allow closure plate (16) to resume its normally closed position.

Examining now, the details of FIGS. 1 and 2, it can be seen that front panel (12) has attached to the rear surface thereof top or mounting plate (20) to which it is attached a myriad of various structures, the details of which will be examined below. Along lower edge (18*d*) is mounted channel (22) on attachment means (24) with springs (26) to bias channel (22) to a position removed from lower edge (18*d*). At top edge (18*c*) it can be seen that there is a similarly dimensioned channel. Also along top edge (18*c*) can be found key member (21) to lock theft determent device (10) into the cabinet of the newspaper vending machine. Blade (21*a*) is normally recessed into slot (21*b*) along top edge of perimeter (18*c*) for insertion and removal of single vend device (10) into cabinet (11). However, once single vend device (10) is inserted into channels (11*a*) and (11*b*) and key member (21) operated, blade (21*a*) is pivoted from its recessed position to project vertically upward and behind lip (11*a*), single vend device (10) is locked into the cabinet (11). Key member (21) allows the anti-theft device (10) of the present invention to be locked within the cabinet of the newspaper vending machine by providing blade (21*a*) to rotatably and lockingly engage the upper lip of the cabinet interior.

Functionally, the devices described in the preceding paragraph will allow the anti-theft device to be lockingly inserted into upper and lower members of walls defining the interior of a standard sized newspaper vending machine cabinet. Such cabinets are well known in the art. An example of one such cabinet is the SHO-RACK ® by Kaspar Wire Works, Inc. of Shiner, Tex., Assignee of the present invention. The anti-theft device (10) as disclosed here is, in fact, dimensionally and structurally suited for insertion into the SHO-RACK ® models number K-80 and TK-80. Both of these models have the elevator shelf rack that will provide for a stack of newspapers to be urged upwards so that the removal of the top edition will allow the stack to move upward so as to continue to provide a stack within reach through cutout (17*a*) and leg (14*b*), but not above trailing edge (16*d*).

Having described now, the general features of front panel (12), T-shaped slot (14) and closure plate (16), we turn now to the varied structure that is located on or about top plate (20). References made to FIGS. 1 and 2 for the following discussion with FIGS. 3, 4, 5, and 6 more particularly describing subcomponents of the devices. As appreciated from the foregoing discussion, it is important that closure plate (16) be locked in the closed position as illustrated in FIG. 1 following the removal of the single purchased edition of a newspaper through T-shaped opening (14). If not, the dishonest consumer could just continue to remove newspapers. Locking pin (32), in engagement with the following structure, achieves such a function. More particularly, actuator engagement arm (28) riding on guide (46) and biased upward by spring (46*a*) engages actuator member (27) of door (25*a*) of the newspaper rack at engagement finger (28*a*), each time door (25*a*) is closed, as seen in FIG. 3. At the removed end of actuator engagement arm (28*b*) and pivoting thereon is pin engagement arm (30). Engagement arm (30) is bias by the influence of the spring (46*a*) to a normally "up" position. Pin engagement arm (30) is pivoted at pivot (40) located on "L-shaped" bracket (37) mounted to the top plate (20).

Pausing momentarily to discuss the function of the locking pin system, it can be seen that the opening and closing of door (25*a*) will raise and lower locking pin (32) through the action of actuator member (27) on arms (28) and (30).

Turning now to FIG. 2 it can be seen that bottom surface (20*b*) of top plate (20) contains a sliding plate (36) flushly mounted and riding thereon. Sliding plate (36) contains many features which are discussed in more detail as follows. Attention is now turned to locking pin (32) which when viewed from the underside of the anti-theft device as illustrated in FIG. 2 can be seen to project through hole (34) in sliding plate (36). In the position as illustrated in FIG. 2 closure plate (16) is locked in the closed position. In this position, it can be appreciated that if locking pin (32) projects through hole (34), sliding plate (36) cannot slide rearward, as will be required to open closure plate (16) and allow access to the newspapers. It can also be appreciated from a look at FIG. 1, that when engagement finger (28*a*) is pressed downward and attachment end (30*a*) of pin engagement arm (30) is lowered, slot end (10*b*) of pin engagement arm (30) will raise locking pin (32). In a raised position, locking pin (32) will allow sliding plate (36) to slide across bottom surface of (20*b*). Thus, the raising and lowering of locking pin (32) into and out of hole (34) of sliding plate (36) will control the ability of closure plate (16) to pivot to an open position.

Turning now to more detail of the unique sliding plate (36) it can be seen that sliding plate (36) rides along bottom surface (20*b*) on paired slotted guides (38) and bolts (33). This bolt and guide system acts in conjunction with lateral guide means (60*a*) and (60*b*) to prevent side-to-side movement and limit the movement of sliding plate (36) to the "fore-and-aft" or "front-and-back" motion along bottom side (20*b*) of top plate (20). Moreover, it can be seen that such for and aft movement of sliding plate (36) is initiated by the movement of closure plates (16) from its normally closed position. That is, sliding plate bias mounts (56*a*) and (56*b*) separated by spring bias (58) press against mounting plate (52) mounted rollers (54) and against rear surface (16*b*) of closure plate (16). It is this means, referenced earlier, that maintains closure plate (16) in a normally closed position. More particularly, it can be seen that sliding plate bias mounts (56*b*) are integral with the sliding plate and an urge sliding plate (36) with its integral mount plates (52) and rollers (54) against the rear surface (16*b*) of closure plate (16).

At this point in our discussion of theft deterrent device (10) we have seen that there is a means for urging closure plate to a closed position and a means for locking and unlocking closure plate (16) into such a closed position, such lock/unlock means engaged by the door opening of the newspaper cabinet. What is needed is a means for arming locking pin (32) and disarming locking pin (32). The details of such means will be more appreciated with referenced to FIGS. 1, 2, 3, and 6.

Upon door closure, engagement finger (28*a*) is pressed downward raising locking pin (32) out of hole (34). Of course, as the door is being closed, the purchased newspaper has already been removed and enclosure plate (16) is in a closed position with hole (34) aligned beneath locking pin (32).

Figure 6:
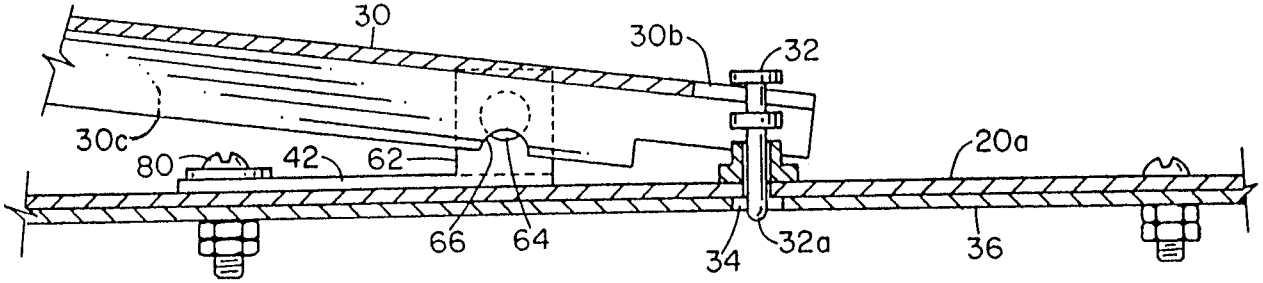
FIG. 6 is a side elevational view, and cutaway, of the resettable locking pin feature of the theft deterrent device removed from the remainder of the device.
Figure 4:
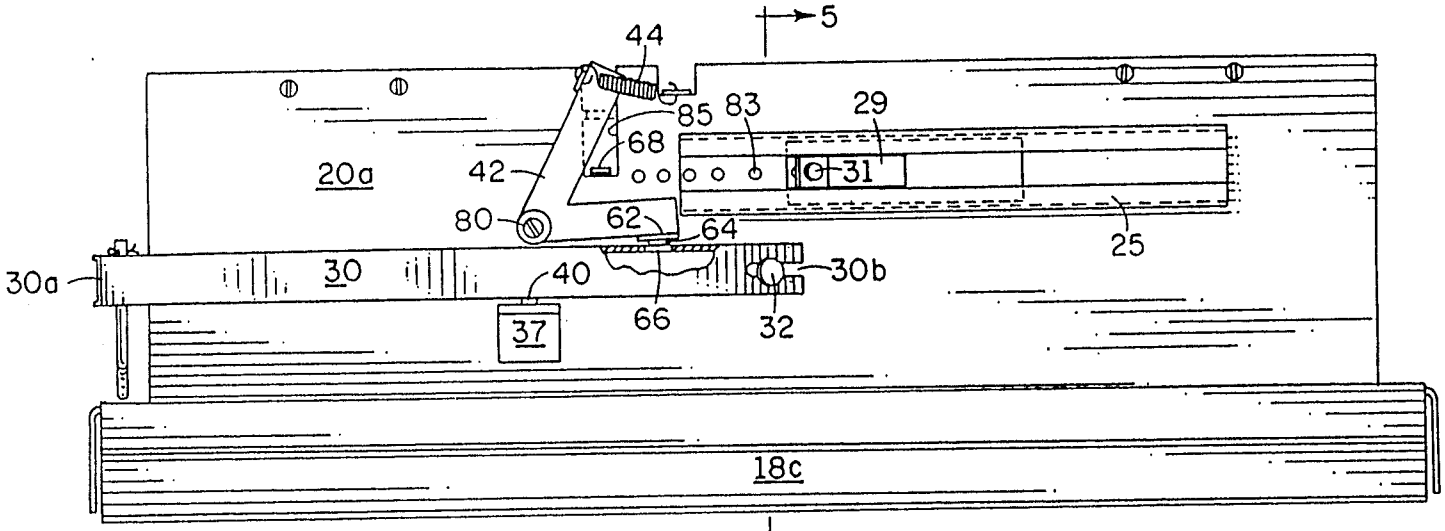
FIG. 4 is a top planiform view of the theft deterrent device
Figure 5:
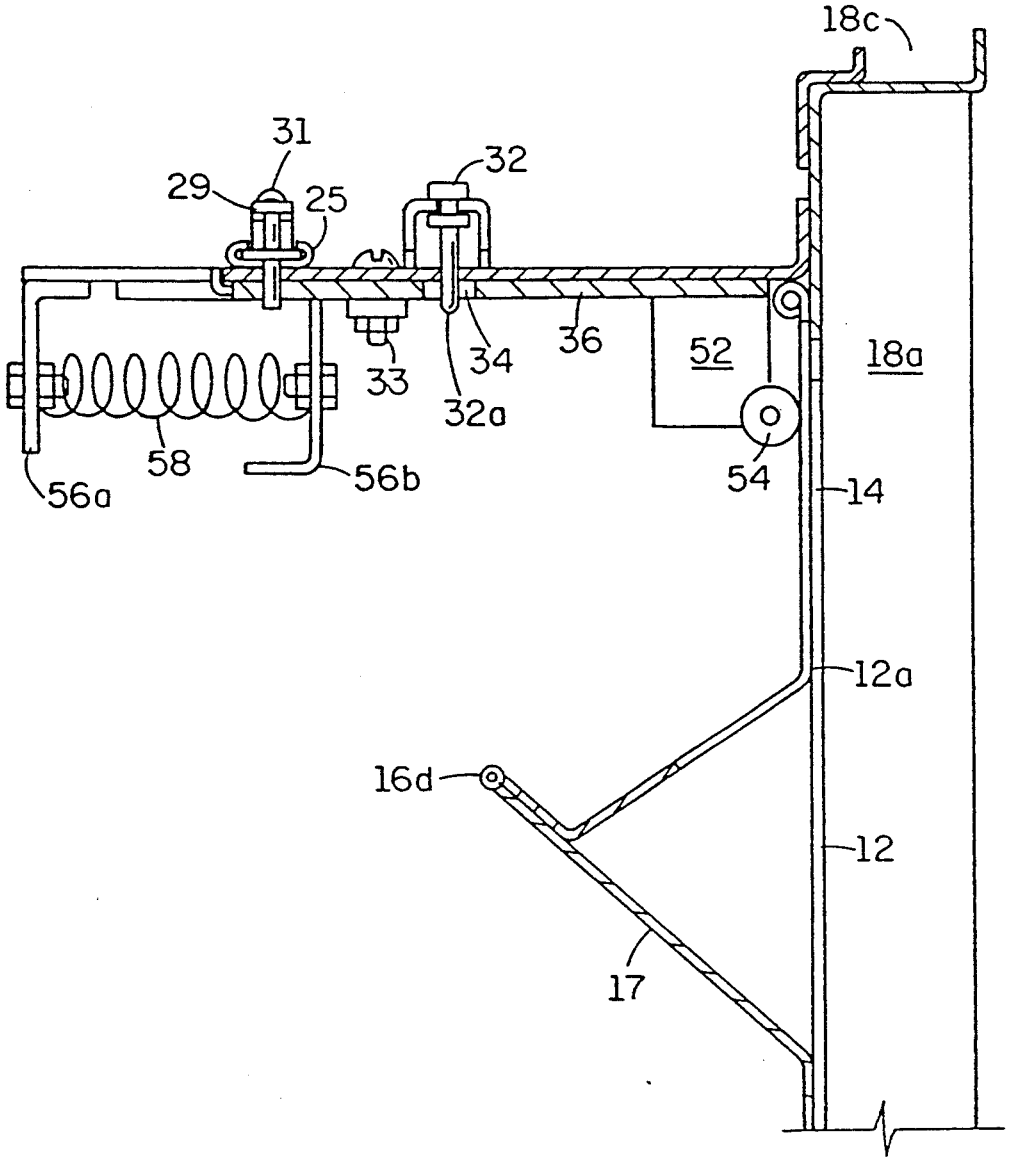
FIG. 5 is a side elevational view and cutaway of the upper portion of the theft deterrent device.

Reference to FIGS. 4, 5 and 6 more clearly illustrates the locking pin reset method. Generally V-shaped reset arm (42) engages both sliding plate (36) at engagement finger (68) and pin engagement arm (30) at locking pin (64) located on mounting arm (62) of reset arm (42). This can be more particularly appreciated in FIG. 6, where reset locking lip (66) on engagement arm (30) is dimensioned to engaging reset locking pin (64). Spring (44) biases reset arm (42) against wall (30*c*) of engagement arm (30). As slotted end (30*b*) of engagement arm (30) is raised, such as upon closing of the door of the newspaper vending machine, actuator engagement arm (28) moves downward and pin (32) will be lifted from hole (34). When pin engagement arm (30) is lifted high enough for the removed end (32*a*) of pin (32) to clear a hole (34), reset locking lip (66) will engage the upper perimeter of reset locking pin (64), thereby preventing slotted end (30*b*), normally bias downwardly, by spring (46*a*), from falling. Thus, this is the condition of theft deterrent device (10) when the next consumer opens the door. That is, the locking pin reset mechanism is in "loaded condition," ready to reset the locking pin.

Engagement finger (68) is an upwardly projecting integral extension of sliding plate (36), passing through groove (85) in top plate (20). As the consumer begins to withdraw the paper through the closure plate the sliding action of rollers (54) move sliding plate (36) rearward, allowing engagement finger (68) to act on and pivot reset arm (42) about pivot (80) (See FIG. 1). This action disengages locking pin (64) from resetting locking lip (66) allowing normally biased pin engagement arm to shift downward at slotted end (30*b*). However, removed end (32*a*) of locking pin (32) will now be riding on the topside of sliding plate (36) as the closure plate opens and begins to close. However, following withdrawal of the newspaper, closure plate (16) moves to the normally biased closed position. Removed end (32*a*) of locking pin will then fall in hole (34) locking sliding plate (36) in place such that rollers (54) block opening of closure plate (16) until door (25*a*) of the vending machine is closed. Thus, it is seen how there are means for setting and resetting locking pin (32) thereby allowing access through T-shaped opening (14).

It remains to be seen, in the following section of the specifications, the manner in which the width of the opening created by pivoting the closure plate may be varied so as to be narrow for the thin daily editions of the newspapers but to be wider for the thicker editions, such as the Sunday editions of the newspaper. What is desired is a means to simply and quickly and adjustably provide for a variety of opening distances between top edge (12*a*) of front panel (12) and leading edge (16*c*) of closure plate (16). Reference to FIGS. 1, 2, 4, and 5 provides an illustration of such a means for width opening adjustment. More specifically, width adjustment means may be seen to include a series of linearly-aligned adjustment holes (83) bored through top plate (20). Aligned with adjustment holes (83) is slide (25) in which rides pin retainer member (29) with closure setting pin (31) slidably engaged therewith. Closure setting pin (31) is free to move up and down within pin retainer member (29). Pin retainer member (29) slides linearly within slide (25) with the pin aligned along the axis of width adjustment holes (83).

Alternate Preferred Embodiments

Figure 1A:
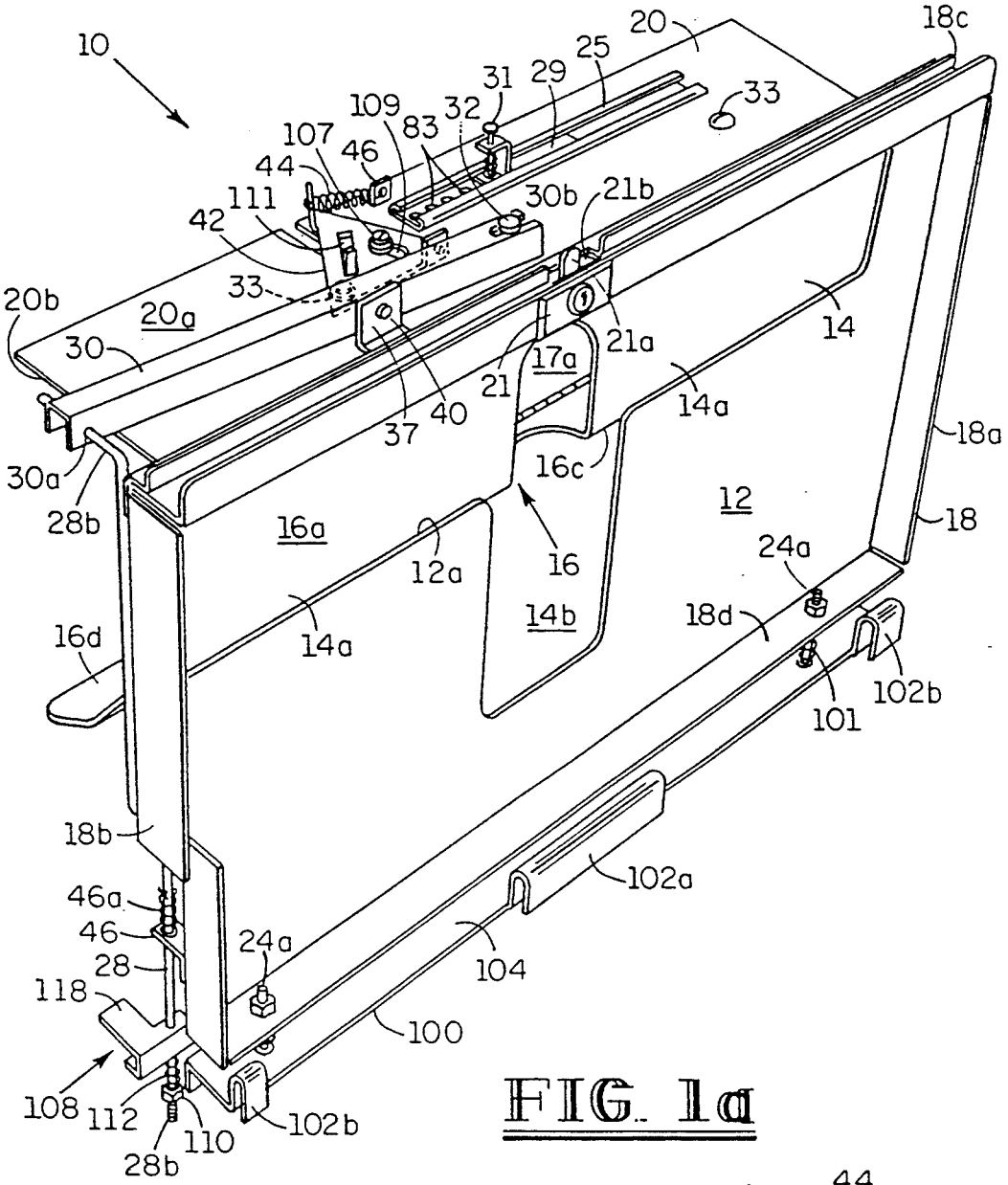
FIG. 1*a* is a prospective view of an alternate preferred embodiment of the present invention, featuring a bracket, a modified reset arm and a modified engagement finger.

FIG. 1*a* discloses an alternate preferred embodiment of Applicant's theft deterrent device (10), the alternate preferred embodiment providing a functional substitute for channel (22), also a modification to reset arm (42), and engagement finger (28*a*).

Figure 1B:
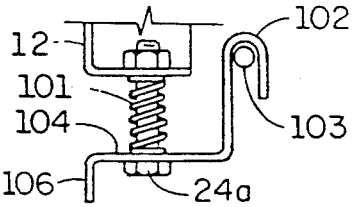
FIG. 1*b* is a side elevational view of the bracket of the alternate preferred embodiment illustrated in FIG. 1*a*

Turning now to FIGS. 1*a*, 1*b* and 1*d*, on lower edge (18*d*) it is seen that attached to and appending below lower edge (18*d*) is bracket (100). Bracket (100) is mounted on guide means (24*a*) here illustrated as the nut-and-bolt combination (FIG. 1*b*) and biased away from lower edge (18*d*) on coil springs or bias means (101). Bracket (100) has a U-shaped channel portion (102) located centrally and at removed ends as illustrated as elements (102*a*) (central) and (102*b*) (ends) (FIG. 1*d*). Channel portions (102*a*) and (102*b*) are dimensioned to accept hinge bar (103) of the door of the cabinet, between hinges (109). Bracket (100) is seen to have a base (104) and a depending lip (106). Thus, the use of bracket (100) allows the technician to install theft deterrent device (10) by using coupling means (22*a*), coupling channel portions (102*a*) and (102*b*) over door hinge bar (103). Compression between bracket (100) and lower edge (18*d*) allows the technician to rotate theft deterrent device (10), now hooked to hinge bar (103), into the opening provided for in the door cabinet, coupling it to the top edge of the opening of the door cabinet as illustrated in FIG. 3. Lock means (21) then allows the technician to secure theft deterrent device (10) into the opening provided for in cabinet (11).

Figure 1C:
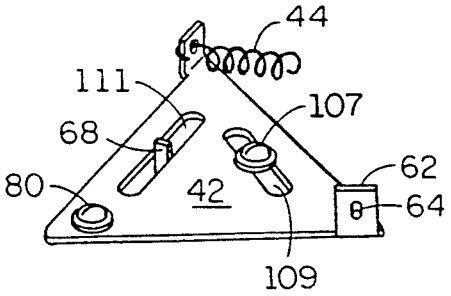
FIG. 1*c* is a top elevational view of an alternate preferred embodiment of Applicant's device showing reset arm apart from the device and having a guide slot therein.
Figure 11D:
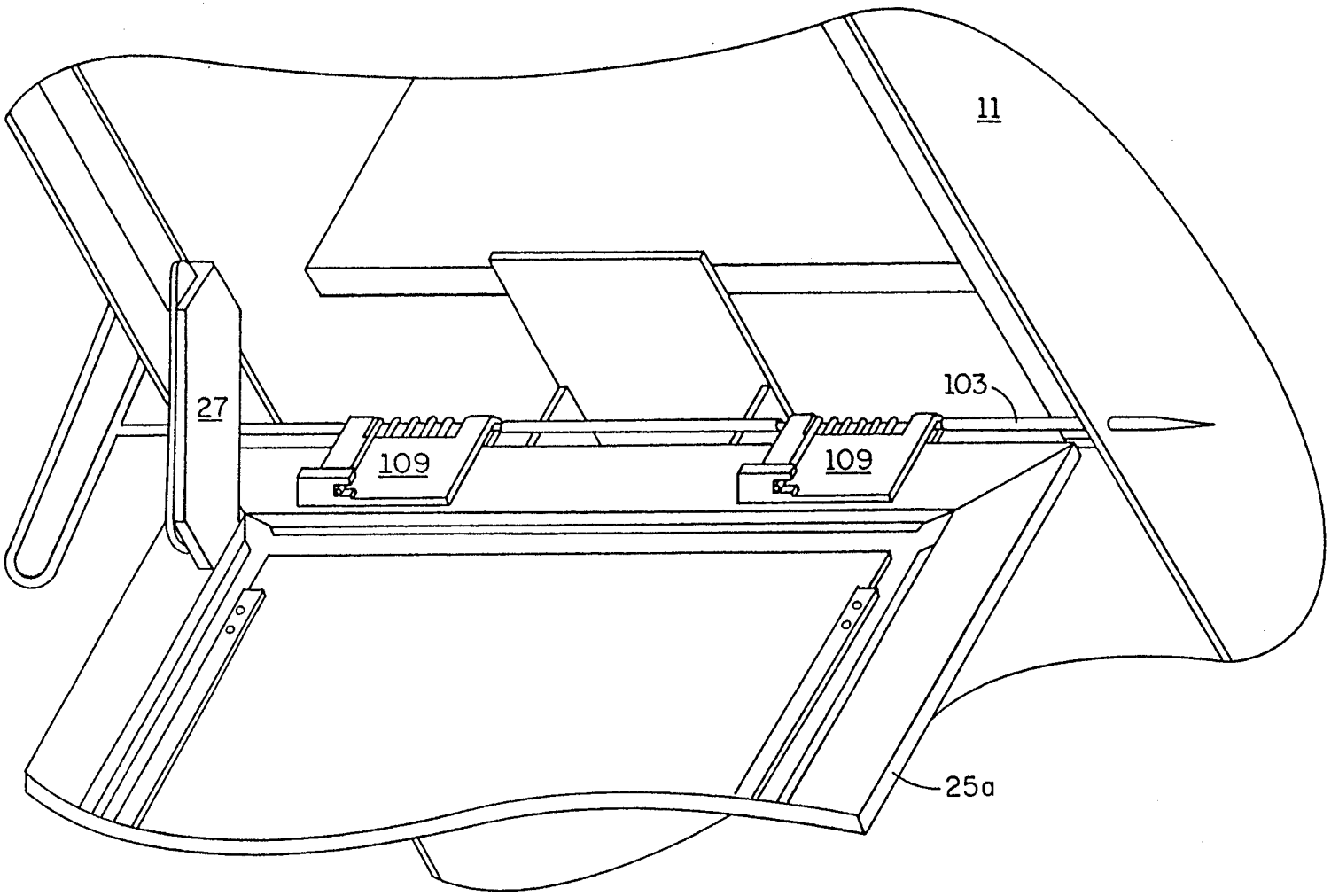

Viewing now FIG. 1*a* in conjunction with FIG. 1*c*, it is seen that reset arm (42) may be modified such that engagement finger (68) rides in guide slot (111). In addition, providing for a second guide slot (109) riding on guide slot means such as nut-and-bolt (107), reset arm (42) may be provided with a more secure, inflexible plane of rotation than that illustrated in the embodiment set forth in FIGS. 1 and 4 which provided for an "open" reset arm (42) whose arms could twist or lift. The embodiment illustrated in FIG. 1*c*, in particular having guide slot (109) and guide means (107), prevents such twisting as reset arm (42) is now anchored to top surface (20*a*) of top plate (20) at two points: (80) and (107). Functionally, the two embodiments of reset arm (42) are the same.

Turning now to FIG. 2, it can be seen that sliding plate (36) has a void (48) cut therein. More particularly, it can be seen in FIG. 2 that sliding plate (36) has pin engagement edge (50) aligned on an oblique angle with the alignment of adjustment holes (83). Thus, by removing closure setting pin (31) from one adjustment hole (83) and sliding pin retainer means (29) in slide (25), closure setting pin (31) may be inserted into any one of the several adjustment holes (83). It can be seen from FIG. 2 that if closure setting pin (31) is set in a hole to be right or near the end of the line of adjustment holes, pin engagement edge (50) will strike pin sooner rather than later. When closure setting pin (31) makes contact with pin engagement edge (50), closure plate (16) can move no further rearward or back, and can only move forward or towards the closed position. Thus, closure setting pin (31) can be set in the furthest adjustment hole to the left as viewed in FIG. 2 for the thickest editions of the newspaper. The series of multiple adjustment holes (83) allows the operator to set an appropriate closure setting width for a multiplicity of sizes of newspapers.

Figure 2B:
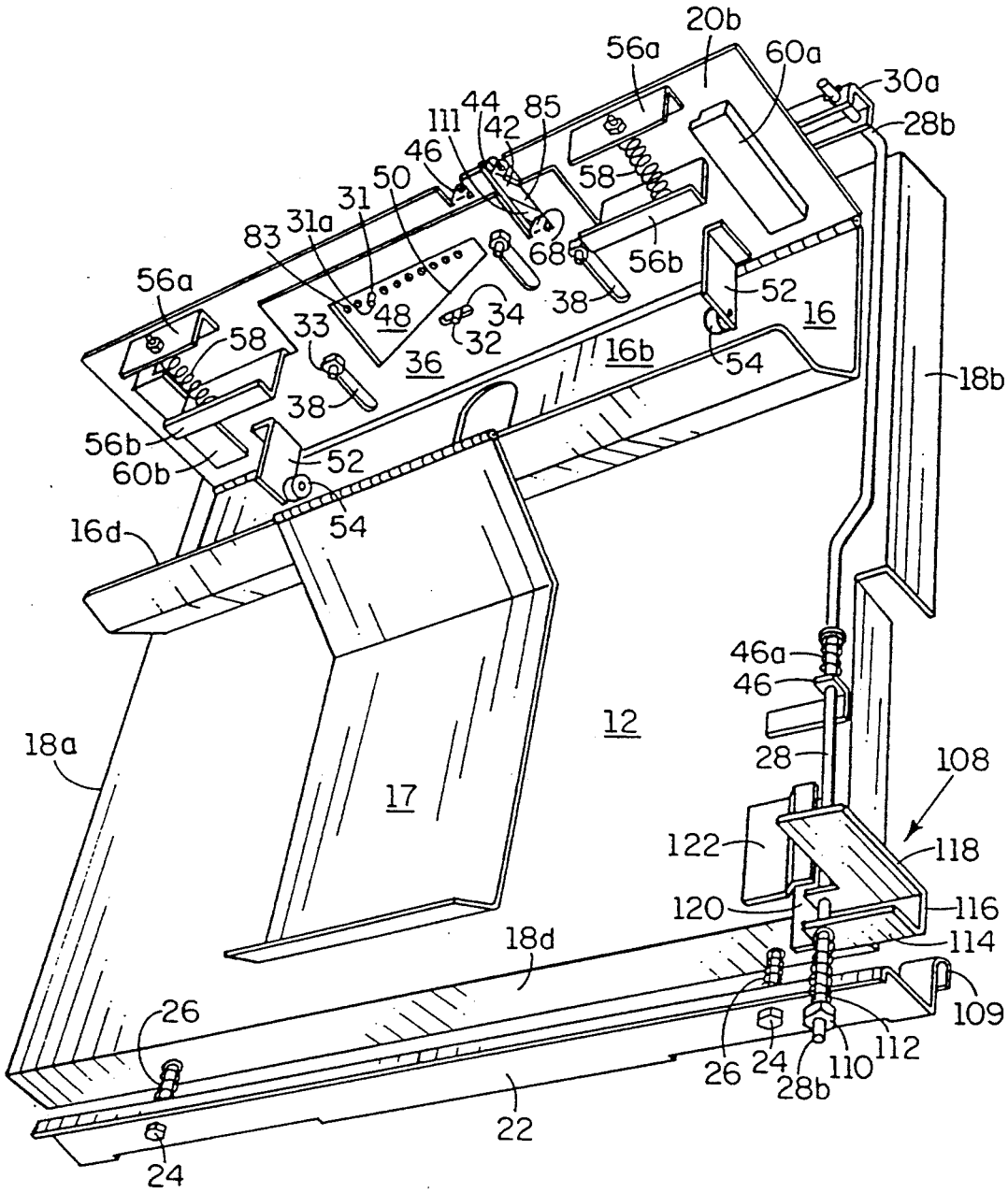
FIG. 2*b* is an alternate preferred embodiment of Applicant's device.

Turning now to FIG. 2*b*, a preferred alternate embodiment is provided to replace or modify engagement finger (28*a*) of actuator engagement arm (28). FIG. 2*b* illustrates door engagement means (108) which is functionally identical to engagement finger (28*a*) but provides for a more stable engagement of device (10) with door. Engagement means (108) is seen to include a J-shaped bracket (109) secured to removed end (28*b*) of actuator engagement arm (28) with nut (110). Bias means (112) such as the coil spring illustrated in FIG. 2*b*, biases J-shaped bracket against underside of lower edge (18*d*). J-shaped bracket (109) is seen to have a short leg (114), a base (116), and a long leg (118). Bias means (112) urges short leg (114) upward so the bracket rests against lower edge (18*d*). Long leg (118) has a perpendicular blade (112) extending from the surface thereof to engage blade guide (122) affixed to rear surface (12) of theft deterrent device (10). Use of door engagement means (108) as provided for and illustrated in FIG. 2*b* allows for a more secure engagement of door actuator member (27) of door (25*a*). Door actuator member (27) engages upper leg (118) of J-shaped bracket (109) as the door closes to depress actuator engagement arm (28) and function as otherwise described above (i.e., as does engagement finger (28*a*)). Although the use of engagement means (108) as illustrated in FIG. 2*b* provides for some additional complexity as compared to engagement finger (28*a*), the use of guide means as provided for by blade (112) and blade guide (122), as well as the increased structural integrity of the J-shaped outline of bracket (109) provides for more secure engagement with door (25*a*).

Thus it can be seen that the present application discloses a device for retrofit into the cabinets of newspaper vending machine racks to prevent the removal of more than one copy of the newspaper for each vend or door opening of the cabinet. The single vend device of the present invention consists of a front panel with a T-slot. The arms of the T-slot are normally closed off with a pivoted closure plate. Consumer access to the newspapers is provided through the leg of the T-slot, but the newspaper must be slid through the gap between the closure plate and the front panel. The thickness of the gap is adjustable to selectively allow for the variation in thickness between various editions of the newspaper. The closure plate is spring loaded to be bias to a closed position. Following removal of the paper, the closure of the plate and a locking pin prevents the plate from re-opening. The locking pin is disarmed upon closure of the cabinet door.

Terms such as "left," "right," "up," "down," "bottom," "top," "front, .... back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

I claim:

1. A retrofit, theft deterrent device for a newspaper vending machine, the machine having a cabinet with walls defining a door opening, the cabinet for enclosing newspapers, an elevator shelf onto which the newspapers are stacked, a pivotally mounted, hinge operated door to provide access to the interior of said cabinet, a means for lockingly engaging said door to the cabinet, and a coin controlled mechanism to activate and deactivate the locking means, said theft deterrent device comprising:

a front panel with a front and a rear surface, for substantially blocking access to the newspaper stack, said front panel having a perimeter thereon dimensioned to removably engage the walls defining the door opening of the cabinet of said newspaper vending machine, said front panel further having walls defining a "Y-shaped " opening, the generally horizontal arms of the opening being of sufficient width to extract a newspaper widthwise therefrom, the generally vertical leg of the opening being substantially less than the width of said newspaper;

means integral with the perimeter of said front panel for providing locking engagement between the perimeter of said front panel to the walls defining the opening of the cabinet, for adapting said front panel to the cabinet of the newspaper vending without the use of tools;

a mounting base with a top and a bottom surface integral with said front panel located above the Y-shaped opening of said front panel, said mounting panel projecting substantially perpendicular from a rear surface of said front panel;

a closure plate pivotally mounted to the rear surface of said front panel above the Y-shaped opening and below said mounting panel, said closure plate dimensioned to substantially cover the arms of the Y-shaped opening, said closure plate having a flat portion and a bent portion, said closure plate with a leading edge defining the boundary between the flat and the bent two portions, said closure plate for moving between a closed position, the closed position with the leading edge substantially flush against the lower edge of the rear surface of the walls defining the arms of the Y-shaped opening, the closed position substantially preventing access to the newspapers, and an open position, the open position achieved by rotation of said closure plate from the closed position until the leading edge of said closure plate is at a position removed from the walls defining the lower edge of the Y-shaped opening, the open position defining an access width through which the newspaper is removed from the interior of the cabinet;

means to adjust the access width of the open position, said means to adjust the access width comprising a sheet slidably mounted to and flush with the bottom surface of said mounting base, the sheet operatively engaged with the rear surface of the closure plate such that the movement of the closure plate towards the open position causes the sheet to slide away from said front panel and across the bottom surface of said mounting base, said means to adjust the access width further comprising walls defining a plurality of linearly aligned adjustment holes through said mounting base, a pin dimensioned to engage the adjustment holes, pin retainment means and a channel mounted in alignment with the adjustment holes to guide the pin retainment means, the access width adjustment means further comprising an edge of the slidably mounted sheet in operative engagement with retainment pin when the pin is inserted through the adjustment holes to adjustably limit the motion of the slidably mounted sheet away from said front panel;

means for biasing said closure plate towards said closed position; and means to resettably lock said closure plate in the closed position following movement of said closure plate from the open position to the closed position.

2. The device of claim 1 wherein said means for providing locking engagement is capable of providing engagement of the device to a Kaspar Model K-80 newspaper cabinet.

3. The device of claim 2 wherein said means for providing locking engagement includes a means to engage the hinge bar of the K-80 newspaper cabinet and a key operated means to engage the walls of the door opening of the K-80 newspaper cabinet.

4. The device of claim 3 wherein said means to engage the hinge bar includes a bracket having U-shaped portion, the bracket disposed below and biased away from the lower edge of said front panel, the U-shaped portion dimensioned to receive the hinge bar of the cabinet.

5. A theft deterrent device for a K-80 style newspaper vending machine, the K-80 newspaper vending machine having a cabinet with walls defining a door opening, the cabinet for enclosing newspapers, an elevator shelf onto which the newspapers are stacked, a pivotally mounted, hinge operated door to provide access to the interior said cabinet, a means for lockingly engaging said door to the cabinet, and a coin controlled mechanism to activate and deactivate the locking means, said theft deterrent device comprising:

front panel having a perimeter thereon dimensioned to removably engage the walls defining the door opening of the cabinet of said newspaper vending machine, said front panel further having walls defining a Y-shaped opening, the generally horizontally arms of the opening being of sufficient width to extract a newspaper therefrom, the generally vertical leg of the opening being substantially less than the width of the newspaper;

means integral with said front panel, said means capable of lockingly securing said front panel into the door opening of the cabinet of the newspaper vending machine without the use of tools;

closure plate pivotally mounted to the rear surface of said front panel above the Y-shaped opening and below said mounting panel, said closure plate dimensioned to cover the arms of the Y-shaped opening when in a closed position and for providing access through the arms of the Y-shaped opening when in an open position;

means to adjust the distance between the open and the closed position of said closure plate to allow for newspapers of various thicknesses to be removed therethrough;

means to lock said closure plate in the closed position as said closure plate moves from the open position to the closed position;

means, engageable with the door of the newspaper vending machine for unlocking the lock means of said closure plate as the door of the newspaper cabinet is opened.

6. The device of claim 5 wherein said lockable coupling means is capable of providing engagement between the device and a Kaspar Model K-80 newspaper cabinet.

7. The device of claim 6 wherein said coupling means includes a means to engage the hinge bar of the K-80 newspaper cabinet and a key operated means to engage the walls of the door opening of the K-80 newspaper cabinet.

8. The device of claim 7 wherein said means to engage the hinge bar includes a bracket having U-shaped portions, the bracket disposed below and biased away from the lower edge of said front panel, the U-shaped portion dimensioned to receive the hinge bar of the cabinet.

9. A theft deterrent device for a newspaper vending machine having cabinet for substantially enclosing newspapers, an elevator shelf onto which the newspapers are stacked, a door pivotally mounted on a hinge bar to provide access to the interior of the cabinet, a means to lockingly engage said door to the cabinet, and a coin controlled mechanism to engage and disengage the locking means, said theft deterrent device comprising:

a front panel with a front and a rear surface for substantially blocking access to the newspaper stack, said front panel having a perimeter thereon dimensioned to removably engage the door opening of the cabinet of said newspaper vending machine, said front panel with walls defining a "Y-shaped" opening, the arms of the opening being of sufficient width to extract a newspaper widthwise therefrom, the leg of the "Y-shaped" opening being substantially less than the width of a newspaper;

key operative locking means engageable with the perimeter of said front panel to lock said front panel to the walls defining the door opening of the cabinet;

a mounting base with a top and a bottom surface integral with said front panel located above the Y-shaped opening of said front panel, said mounting base projecting substantially perpendicular from the rear surface of said front panel;

a closure plate pivotally mounted to the rear surface of said front panel above said Y-shaped opening and below said mounting base, said closure plate dimensioned to substantially cover the arms of the Y-shaped opening, said closure plate having a flat portion and a bent portion, said closure plate with a leading edge defining the edge between the two portions, said closure plate for moving between a closed position, the closed position with the leading edge substantially flush against the lower edge of the rear surface of the walls defining the arms of the Y-shaped opening, the closed position substantially preventing access to said newspapers, and an open position, said open position reached by rotation of said closure plate from the closed position until the leading edge of said closure plate is at a position removed from the walls defining the lower edge of the Y-shaped opening, the open position defining an access width through which the newspaper is removed from the interior of the cabinet;

a sheet slidably mounted to and flush with the bottom surface of said mounting base, the sheet operatively engaged with the rear surface of the closure plate such that movement of the closure plate towards the open position causes the sheet to slide away from said front panel and across the bottom surface of said mounting base;

means to adjust the access width of the open position of said closure plate, said means comprising walls defining a line of adjustment holes through said mounting base, a pin dimensioned to engage the adjustment holes, pin retainment means, and a channel mounted in alignment with the adjustment holes to guide the pin retainment means, the width adjustment means further comprising an edge of said slidably mounted sheet, the edge in acute angular relationship to the line of adjustment holes for engagement with the pin;

means biasing said closure plate towards the closed position;

means to resettably lock the closure plate in the closed position, said closure plate lock means comprising arm means, pin means, reset means, and walls defining a pair of holes, one of the pair being in said mounting base and the other of the pair being in said sliding sheet, the pairs being in vertical alignment when said closure plate is in the closed position, the arm means coupled to the door of the newspaper cabinet, the arm means to raise the pin out of the aligned holes in said sliding sheet and said mounting plate when said closure plate is in the closed position, the pin released from its raised position by reset means upon movement of the closure plate from the closed position, thereby allowing the pin to re-engage the holes upon return of said closure plate to the closed position.

10. The device of claim 9 wherein said front panel has a hooked shape portion along a lower edge of the perimeter, the hooked shape portion engageable with the hinge bar of the cabinet to mount the theft deterrent device thereon.

* * * * *